US007027763B2

(12) United States Patent
Kato et al.

(10) Patent No.: US 7,027,763 B2
(45) Date of Patent: Apr. 11, 2006

(54) IMAGE HEATING APPARATUS HAVING FLEXIBLE ROTATABLE MEMBER

(75) Inventors: Akira Kato, Shizuoka (JP); Noriaki Tanaka, Shizuoka (JP); Yusuke Nakazono, Shizuoka (JP); Hiroyuki Sakakibara, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 19 days.

(21) Appl. No.: 10/724,634

(22) Filed: Dec. 2, 2003

(65) Prior Publication Data

US 2004/0151522 A1 Aug. 5, 2004

(30) Foreign Application Priority Data

Dec. 5, 2002 (JP) ..... 2002-353596

(51) Int. Cl.
*G03G 15/20* (2006.01)

(52) U.S. Cl. ..... 399/329; 399/328

(58) Field of Classification Search ..... 399/320, 399/328, 329; 219/216
See application file for complete search history.

(56) References Cited

U.S. PATENT DOCUMENTS 5,267,005 A * 11/1993 Yamamoto et al. ..... 399/329
5,828,035 A * 10/1998 Kuroda ..... 219/216
5,852,763 A * 12/1998 Okuda et al. ..... 399/329
5,874,710 A * 2/1999 Yoshimoto et al. ..... 219/216
5,920,757 A * 7/1999 Izawa et al. ..... 399/329
6,094,559 A 7/2000 Otsuka et al. ..... 399/327
6,157,806 A * 12/2000 Elbert et al. ..... 399/329
6,175,699 B1 1/2001 Kato et al. ..... 399/69
6,459,878 B1 10/2002 Tomoyuki et al. ..... 399/331
6,516,166 B1 2/2003 Sakakibara et al. ..... 399/69
6,518,546 B1 * 2/2003 Otsuka et al. ..... 219/216
6,615,017 B1 9/2003 Tanaka ..... 399/322
6,618,574 B1 * 9/2003 Nishitani ..... 399/329
6,647,216 B1 11/2003 Tanaka ..... 399/21
2002/0127035 A1 9/2002 Otsuka et al. ..... 399/329
2003/0077092 A1 4/2003 Ogawa et al. ..... 399/328
2003/0196999 A1 10/2003 Kato et al. ..... 219/216

* cited by examiner

*Primary Examiner*—Sandra L. Brase
(74) *Attorney, Agent, or Firm*—Fitzpatrick, Cella, Harper & Scinto

(57) ABSTRACT

The image heating apparatus for heating an image formed on a recording material includes a heater, a supporting member for supporting the heater, a flexible rotatable member rotated while contacting with the heater, and a backup member contacting with the rotatable member. The recording material passes between the rotatable member and the backup member, and upstream of the heater of the supporting member with respect to the direction of movement of the recording material, there are provided a protruding portion protruding more toward the backup member side than the surface of contact between the heater and the rotatable member, and a groove portion provided between the protruding portion and the heater and depressed more than the surface of contact of the heater with the rotatable member, and a lubricant is contained in the groove portion. Thereby, the driving torque of the rotatable member can be suppressed.

5 Claims, 11 Drawing Sheets

IMAGE HEATING APPARATUS HAVING FLEXIBLE ROTATABLE MEMBER

BACKGROUND OF THE INVENTION

1. Field of the Invention

This invention relates to an image heating apparatus suitable for use as a heat fixing device carried on an image forming apparatus such as a copying machine or a printer, and particularly to an image heating apparatus having a heater and a flexible rotatable member rotated while contacting with the heater, and for heating an image through the flexible rotatable member.

2. Description of Related Art

Description will hereinafter be made of an example in which a conventional heating apparatus is applied as an image heating apparatus (fixing apparatus) provided in an image forming apparatus such as a copying machine or a printer for heating and fixing a toner image on a recording material.

In image forming apparatuses, a heating apparatus of a heat roller type has been widely used as a fixing apparatus for heating and fixing an unfixed image (toner image) of image information formed and borne on a recording material (such as a transferring material sheet, an electrofax sheet, electrostatic recording paper, an OHP sheet, printing paper or format paper, in a suitable image forming process means portion such as an electrophotographic process, an electrostatic recording process or a magnetic recording process by a transferring method or a direct method as a permanent fixed image on the surface of the recording material.

In recent times, a heating apparatus of a film heating type has been proposed and put into practical use from the viewpoints of quick start and energy saving.

This heating apparatus of the film heating type, as shown in FIG. 10 of the accompanying drawings, is such that film (rotatable member) 52 generally including therein a ceramic heater (hereinafter referred to also as the heater) 51 as a heating member and a guide member 54, and a pressure roller 53 as a discrete rotatable member brought into pressure contact with the film 52 are supported by a supporting member, not shown, and the two rotatable members 52 and 53 are pressed by pressing means 55 to thereby form a pressure contact nip part N.

The film 52 is driven to rotate around the guide member 54 with the inner surface thereof sliding in close contact with the heating surface of the heater 51 at the pressure contact nip part N by the pressure roller 53 being rotatively driven. In this case, in order to reduce the sliding friction resistance between the inner surface of the film and the heater or the guide member to thereby smooth the rotation of the film 52, a lubricant such as heat-resistant grease is interposed between the heating surface of the heater 51 and the inner surface of the film.

That is, the heat-resistant film 52 (hereinafter referred to also as the fixing film, the fixing belt or the film) is nipped between the heater 51 and the pressure roller 53 as a pressure member to thereby form the pressure contact nip part (a heating nip part or a fixing nip part), and a recording material P as a material to be heated on which an unfixed toner image to be fixed is formed and borne is introduced into between the fixing film 52 and the pressure roller 53 at the pressure contact nip part N and is nipped and transported with the fixing film 52, whereby at the pressure contact nip part N, the heat of the ceramic heater 51 is given to the recording material P through the fixing film 52, and the unfixed toner image is heat pressure-fixed on the surface of the recording material by the pressure force of the pressure contact nip part N.

The image heating apparatus applied as the above-described fixing apparatus can also be used, for example, as an apparatus for heating a recording material bearing an image thereon to thereby improve a surface property such as gloss, an apparatus for tentatively fixing an image, etc.

This image heating apparatus of the film heating type can constitute an apparatus of an on-demand type by the use of a ceramic heater and a member of low heat capacity as the fixing film, and has the merits that only during the execution of image forming of the image forming apparatus, the ceramic heater can be electrically energized and brought into a state in which it generates heat to a predetermined fixing temperature, and that the waiting time from the switching-on of the power source of the image forming apparatus till a state in which image forming can be executed is short (a quick starting property) and the electric power consumption during standby becomes greatly small (electric power saving).

In the image heating apparatus of the film heating type, methods of driving cylindrical or endless fixing film as a rotatable member include a method of rotating the fixing film brought into pressure contact by a film guide member (film supporting member) for guiding the inner peripheral surface of the fixing film and a pressure roller by the rotative driving of the pressure roller (a pressure roller driving method), a method of rotating a pressure roller by the driving of endless fixing film passed over a driving roller and a tension roller (a fixing film driving method), etc.

However, the above-described heating apparatus (fixing apparatus) of the film heating type has suffered from the following problems.

There has been the tendency of rotational torque increasing with an increase (endurance) in the number of printed sheets. That is, with an increase (endurance) in the number of printed sheets, the film or the heating member is gradually shaved by sliding friction or the like, and the lubricant is deteriorated under the influence of the shavings thereof or the like and circulation becomes bad. As the result, the mutual frictional forces of the film and the heating member are increased and thus, rotational torque is increased.

Accordingly, when an attempt is made to make the apparatus higher in speed or longer in life, there occurs the inconvenience that for example, a driving motor loses synchronism due to the increase in the torque or paper becomes untransported (fixing slip jam) due to the film being faultily driven. Also, in an extreme case, there has occurred the inconvenience that the film is damaged.

In recent years, further speedup, electric power saving, lower costs and downsizing have been required of image forming apparatuses such as copying machines and printers, and the toner fixing property onto the recording material must be secured while speedup is accomplished. Therefore, when a pressure force is increased, the driving motor loses synchronism due to an increase in rotational torque, or an inconvenience such as fixing jam occurs.

Or it has been practised to increase the width of the heating member in order to increase the width of the fixing nip (secure the toner fixing property), but an increase in the width of the heating member means an increase in the cost of materials or the larger size of the heating member, and such members as the film and the supporting member become large, and a unit itself becomes bulky.

Further, it as shown in FIG. 9 of the accompanying drawings, the width of the heating member is made small and the width of the nip is secured, in a case where the heater protrudes from the film guide member, the film 52 when it slides strongly strikes against the edge portion of the heating member 51 and therefore, the friction between the film 52 and the heating member 51 becomes great, and rotational torque is increased. Further, when the recording material P is supplied, it strongly strikes against the edge portion of the heating member 51, whereby a transport load suddenly rises and the pressure roller 53 becomes unable to transport the recording material P, that is, a so-called slip phenomenon occurs. Of course, if the width of the nip is made small so that the recording paper may not strike against the edge portion, it becomes impossible to secure the fixing property. Or when the heater is retracted from the film guide member, the heat of the heater is not property transferred to the film, and this gives rise to the problem that the fixing property cannot be secured.

SUMMARY OF THE INVENTION

The present invention has been made in view of the above-noted problems and an object thereof is to provide an image heating apparatus in which the driving torque of a rotatable member can be suppressed.

Another object of the present invention is to provide an image heating apparatus in which the fluctuation of pressure applied to a heater can be suppressed even if the cumulative operating time of the apparatus becomes long.

Still another object of the present invention is to provide an image heating apparatus for heating an image formed on a recording material, comprising:

a heater;

a supporting member for supporting the heater;

a flexible rotatable member rotating while contacting the heater; and a backup member contacting the rotatable member;

wherein the recording material passes between the rotatable member and the backup member, and wherein upstream of the heater of the supporting member with respect to the direction of movement of the recording material, there are provided a protruding portion protruding more toward the backup member side than the surface of contact of the heater with the rotatable member, and a groove portion provided between the protruding portion and the heater and depressed more than the surface of contact of the heater with the rotatable member, and a lubricant is contained in the groove portion.

Further objects of the present invention will become apparent from the following detailed description when read with reference to the accompanying drawings.

DETAILED DESCRIPTION OF THE PREFERRED EMBODIMENTS (First Embodiment)

An image heating apparatus according to this embodiment is an image heating and fixing apparatus of a pressure roller driving type using fixing film (fixing belt) as a flexible rotatable member.

1) Example of an Image Forming Apparatus

Figure 1:
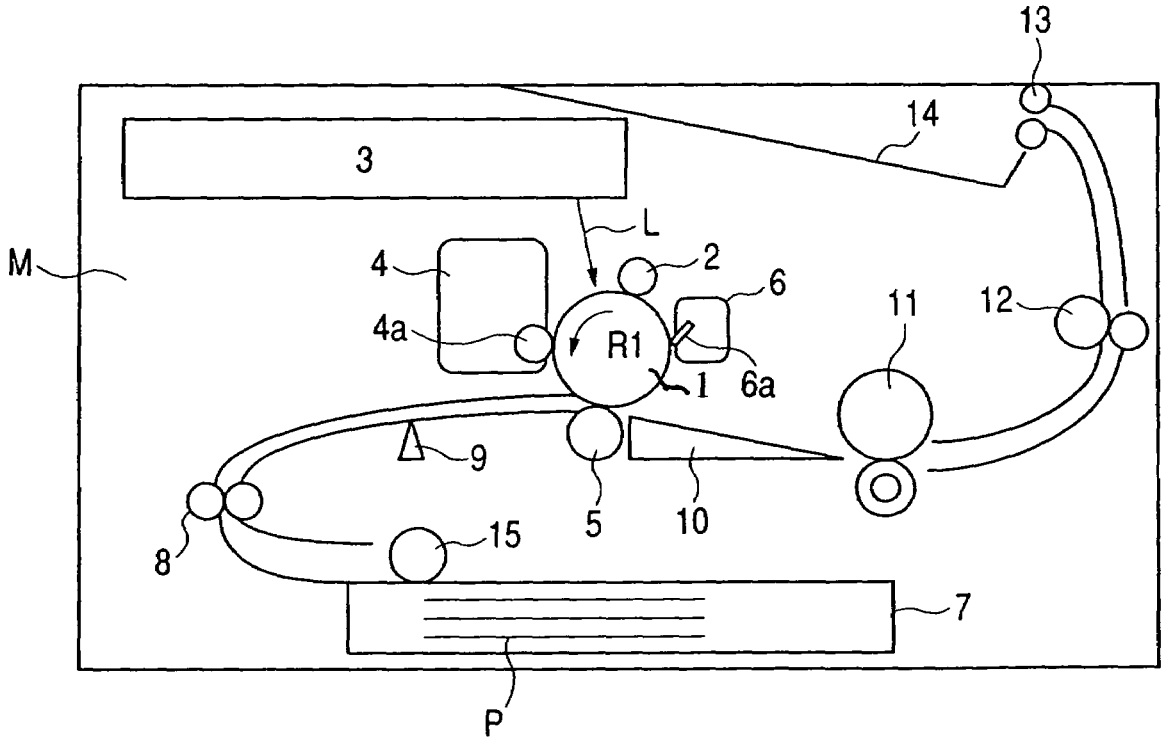
FIG. 1 is a longitudinal cross-sectional view schematically showing the construction of an example of an image forming apparatus.

FIG. 1 is a longitudinal cross-sectional view schematically showing the construction of a laser beam printer (hereinafter referred to as the image forming apparatus) as an example of an image forming apparatus provided with the heating apparatus according to the present invention as a fixing apparatus.

This image forming apparatus is provided with a drum-shaped electrophotographic photosensitive member (hereinafter referred to as the photosensitive drum) 1 as an image bearing member. The photosensitive drum 1 is rotatably supported in an apparatus main body M, and is rotatively driven at a predetermined process speed in the direction of arrow R1 by driving means (not shown).

A charging roller (charging apparatus) 2, exposing means 3, a developing apparatus 4, a transferring roller (transferring apparatus) 5 and a cleaning apparatus 6 are disposed substantially in the named order around the photosensitive drum 1 along the direction of rotation thereof.

Also, in the lower portion of the apparatus main body M, there is disposed a sheet feeding cassette 7 containing sheet-like recording materials P such as paper therein, and a sheet feeding roller 15, transporting (conveying) rollers 8, a top sensor 9, a transport (conveying) guide 10, a fixing apparatus 11 which is the heating apparatus according to the present invention, transporting (conveying) rollers 12, delivery rollers 13 and a delivery tray 14 are disposed along the transport route of the recording material P in succession from the upstream side.

The operation of the image forming apparatus of the above-described construction will now be described.

The photosensitive drum 1 rotatively driven in the direction of arrow R1 by the driving means (not shown) is uniformly charged to a predetermined polarity and predetermined potential by the charging roller 2. The photosensitive drum 1 after charged has its surface subjected to image exposure L based on image information by the exposing means 3 such as a laser optical system, and has the charges of its exposed portion removed, whereby an electrostatic latent image is formed thereon.

The electrostatic latent image is developed by the developing apparatus 4. The developing apparatus 4 has a developing roller 4*a*, and a developing bias is applied to the developing roller 4*a* to thereby cause a toner to adhere to the electrostatic latent image on the photosensitive drum 1, thereby effecting development (visualization) as a toner image.

The toner image is transferred to the recording material P such as paper by the transferring roller 5. The recording material P is contained in the sheet feeding cassette 7, and is fed and transported by the sheet feeding roller 15 and the transporting rollers 8, and is transported to the transferring nip part between the photosensitive drum 1 and the transferring roller 5 through the top sensor 9. At this time, the recording material P has its leading edge detected by the top sensor 9, and is synchronized with the toner image on the photosensitive drum 1. A transferring bias is applied to the transferring roller 5, whereby the toner image on the photosensitive drum 1 is transferred to a predetermined location on the recording material P.

The recording material P now bearing an unfixed toner image on the surface thereof by the transfer is transported to the fixing apparatus 11 along the transport guide 10, and the unfixed toner image thereon is heated and pressurized there and is fixed on the surface of the recording material P. The fixing apparatus 11 will be described later in detail. The recording material P after the fixing of the toner image is transported and delivered onto the delivery tray 14 on the upper surface of the apparatus main body M by the transporting rollers 12 and the delivery rollers 13.

On the other hand, any toner residual on the photosensitive drum 1 after the transfer of the toner image (hereinafter referred to as the untransferred toner) is removed by the cleaning blade 6*a* of the cleaning apparatus 6, and the photosensitive drum 1 becomes ready for the next image forming. By the above-described operation being repeated, image forming can be effected sequentially.

2) Fixing Apparatus 11

Figure 2:
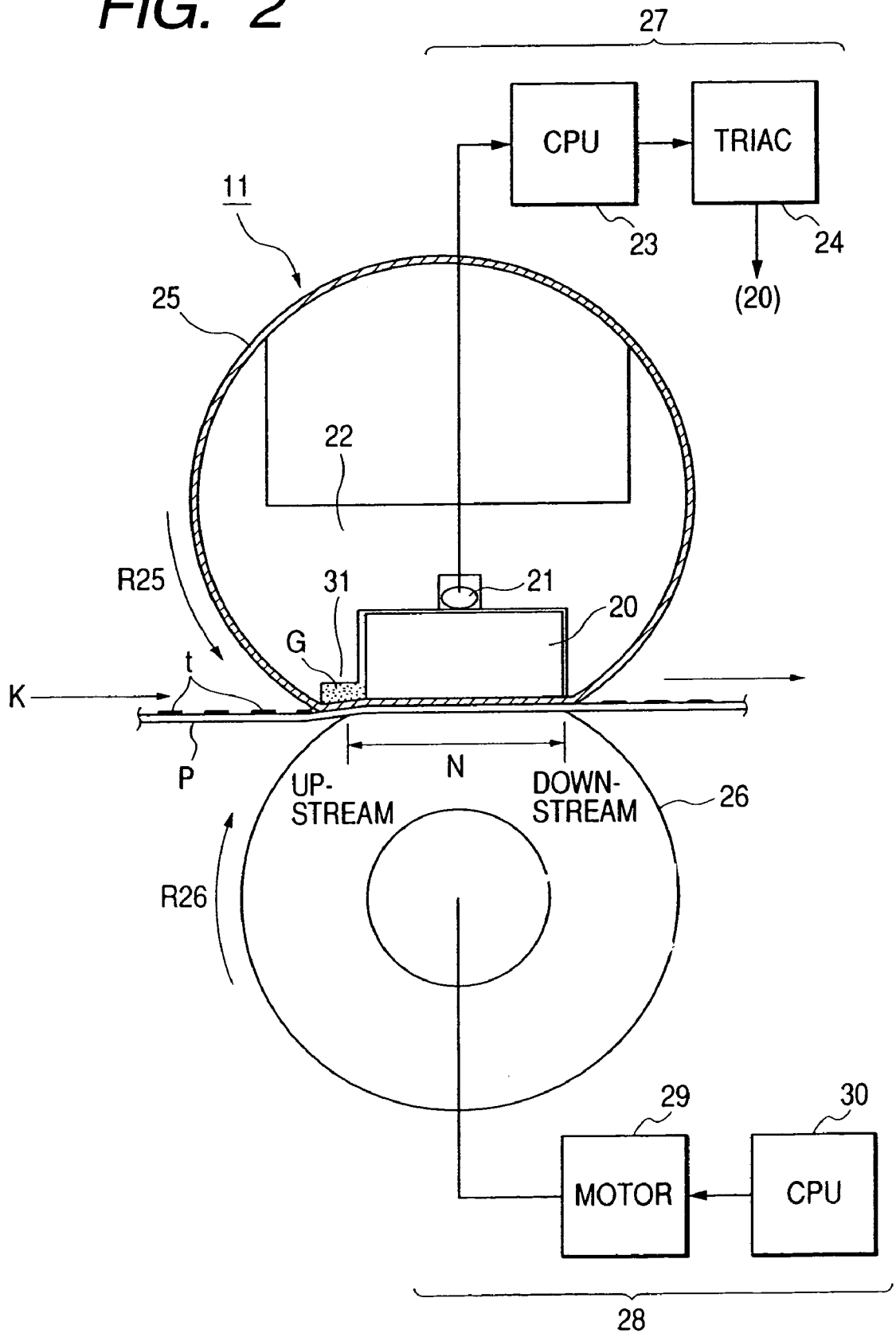
FIG. 2 is a transverse cross-sectional view schematically showing the construction of a fixing apparatus according to a first embodiment of the present invention.

An example of the fixing apparatus 11 as the image heating apparatus according to the present invention will now be described in detail with reference to FIG. 2. FIG. 2 is a transverse cross-sectional view of the fixing apparatus along the transport direction (the direction of arrow K) of the recording material P.

The fixing apparatus 11 shown in FIG. 2 has as its main constituent members a ceramic heater 20 as a heating member for heating the toner, fixing film (a flexible rotatable member) 25 including this heater 20 therein, a pressure roller 26 as a backup member brought into contact with the fixing film 25, temperature controlling means 27 for controlling the temperature of the heater 20, and rotation controlling means 28 for controlling the transport of the recording material P.

The heater 20 is supported by a holding member 22 (hereinafter referred to as the heater holder) mounted on the apparatus main body M. The heater holder 22 is a member formed into a semicircular shape by heat-resistant resin, and acts also as a guide member for guiding the rotation of the fixing film 25.

The fixing film 25 comprises heat-resistant resin such as polyimide formed into a cylindrical shape, and is rotated around the heater 20 and the heater holder 22. The fixing film 25 is urged against the heater 20 by the pressure roller 26 which will be described later), whereby the back (inner peripheral surface) of the fixing film 25 is adapted to be brought into contact with the underside of the heater 20. The fixing film 25 is designed to be rotated in the direction of arrow R25 as the recording material P is transported in the direction of arrow K by the rotation of the pressure roller 26 in the direction of arrow R26. The right and left end portions (lengthwisely opposite end portions) of the fixing film 25 are regulated by the guide portions (not shown) of the heater holder 22 so as not to come off from the lengthwise direction of the heater 20.

The rotation controlling means 28 has a motor 29 for rotatively driving the pressure roller 26, and a CPU 30 for controlling the rotation of this motor 29. For example, the motor 29 can be used, for a stepping motor or the like, and it is possible to effect the rotation of the pressure roller 26 continuously in the direction of arrow R26 and besides, intermittently by each predetermined angle. That is, it is also possible to step-feed the recording material P while repeating the rotation and stoppage of the pressure roller 26.

The temperature controlling means 27 has a thermistor (temperature detecting element) 21 attached to the back of the heater 20, and a CPU 23 for controlling a triac 24 on the basis of a temperature detected by the thermistor 21 to thereby control the supply of electric power to the heater 20.

As described above, the fixing apparatus 11 nips and transports the recording material P by the fixing nip part N with the aid of the rotation of the pressure roller 26 in the direction of arrow R26 and at the same time, heats the toner t on the recording material P by the heater 20. At this time, the rotation of the pressure roller 26 is controlled by the rotation controlling means 28, whereby the transport of the recording material P can be suitably controlled, and the temperature of the heater 20 can be suitably controlled by the temperature controlling means 27.

The characteristic portion of the present embodiment will now be described in detail. The heater holder 22 in the present embodiment has a protruding portion 32 protruding from the surface of contact of the heater 20 with the fixing film 25 toward the pressure roller side, and a groove portion 33 provided between the protruding portion 32 and the heater 20, and depressed more than the surface of contact of the heater 20 with the fixing film 25. A lubricant G is contained in the groove portion 33.

The reference numeral 31 designates a portion of the heater holder 22, and a portion cooperating with the protruding portion 32 of the heater holder 22 to constitute the groove portion 33 for holding the lubricant therein. The groove portion 33 is provided along the length of the heater upstream of the heater 20 (upstream of the nip) with respect to the direction of movement of the fixing film.

Figure 3:
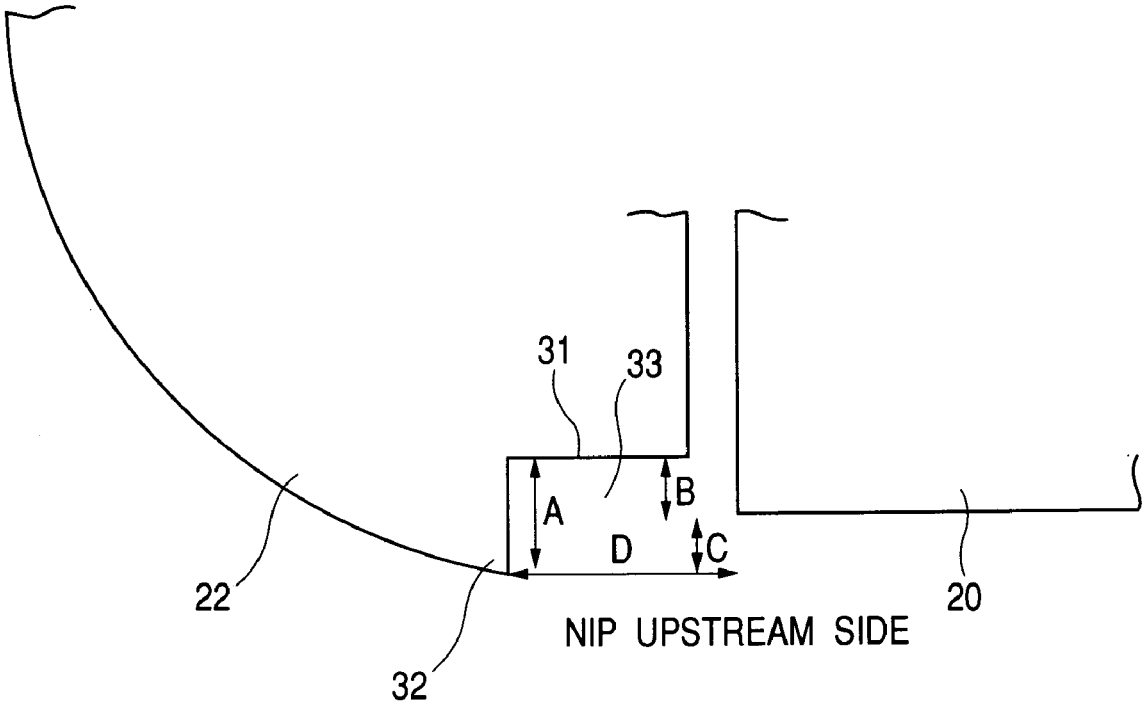
FIG. 3 is a detailed view showing the construction of the nip part of the fixing apparatus according to the first embodiment.

FIG. 3 is an enlarged model view of the vicinity of the groove portion 33 upstream of the nip. This FIG. 3 shows the relation between the heater holder 22 and the heater 20 forming the groove portion 33. The letter A denotes the depth of the groove portion 33 (the length from the protruding portion 32 to a bottom surface portion 31), the letter B designates the depth from a portion (bottom surface portion) 31 of the heater holder 22 to the fixing film sliding surface of the heater 20, the letter C denotes the depth of the surface of the heater 20 from the protruding portion 32 of the heater holder 22, and the letter D designates the distance from the end of the groove portion of the heater holder 22 to the end of the heater 20 (the width of a clearance portion).

The depth A is set to 0 mm or greater and 0.4 mm or less, the depth B is set to 0 mm or greater and equal to or less than the aforementioned depth A, and the distance D is set to 5 times as great as the aforementioned depth A or greater. The positional relation in the present embodiment adopts A=0.2 mm, B=0.1 mm, C=0.1 mm and D=1.7 mm.

This is a positional relation in which even when the nip width (which, in the present invention, corresponds to the width of contact between the fixing film and the pressure roller) is greater than the width of the heater, the heat-resistant film 25 does not strongly strike against the edge of the heater. These positional relations are suitably set depending on the hardness of the pressure roller and the life number of sheets of the apparatus, but it will suffice if at least the protruding portion 32 of the heater holder protrudes more toward the pressure roller 26 side than the surface of contact of the heater 20 with the fixing film and the bottom surface of the groove portion 33 is more depressed than the surface of contact of the heater 20 with the fixing film. In the present embodiment, there is supposed an apparatus in which the initial hardness of the pressure roller is 47° (Asker-C total load 5.88 N) and the life is 100,000 sheets.

Figure 8:
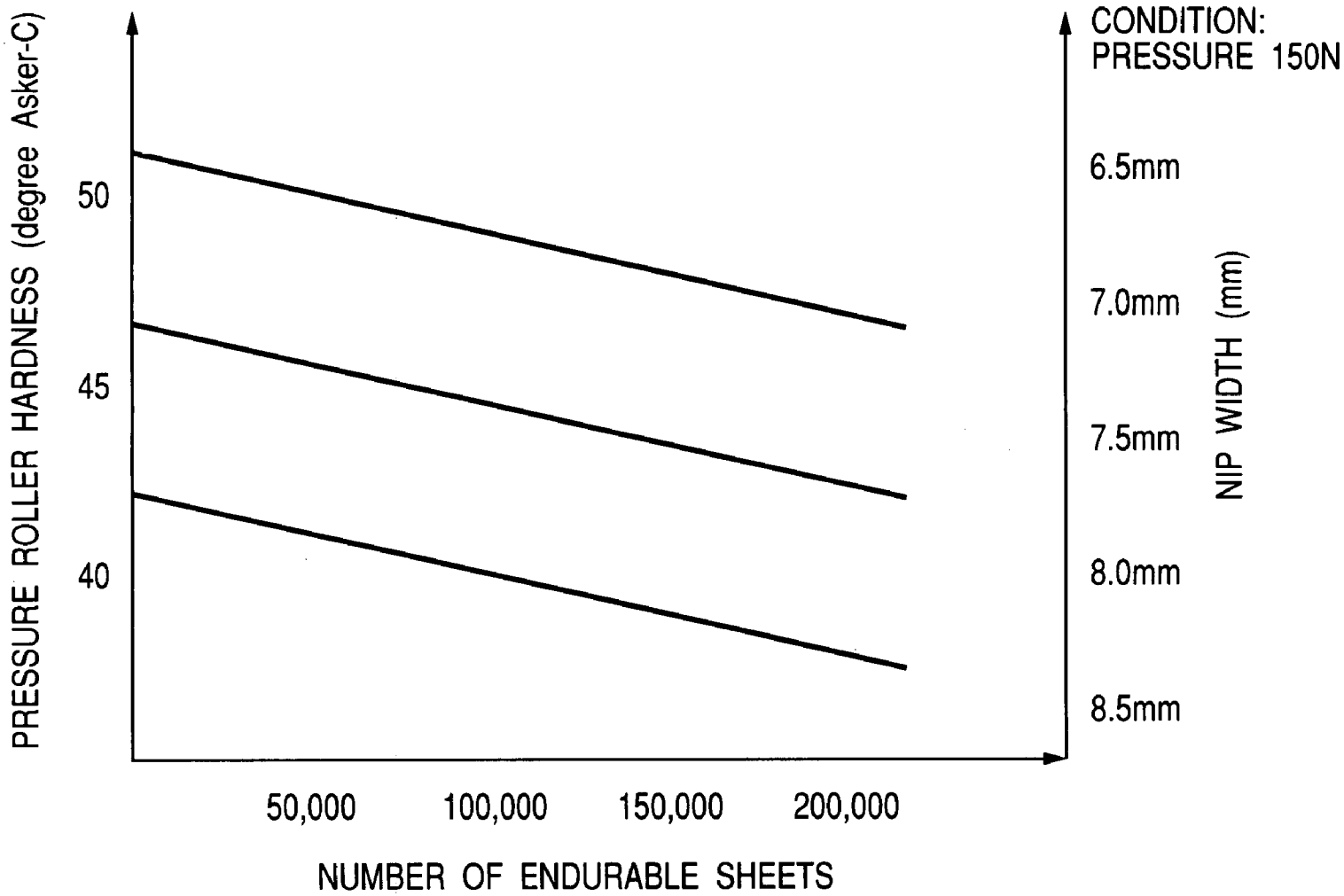
FIG. 8 shows changes in hardness and nip width by the endurance according to the present invention.
Figure 9:
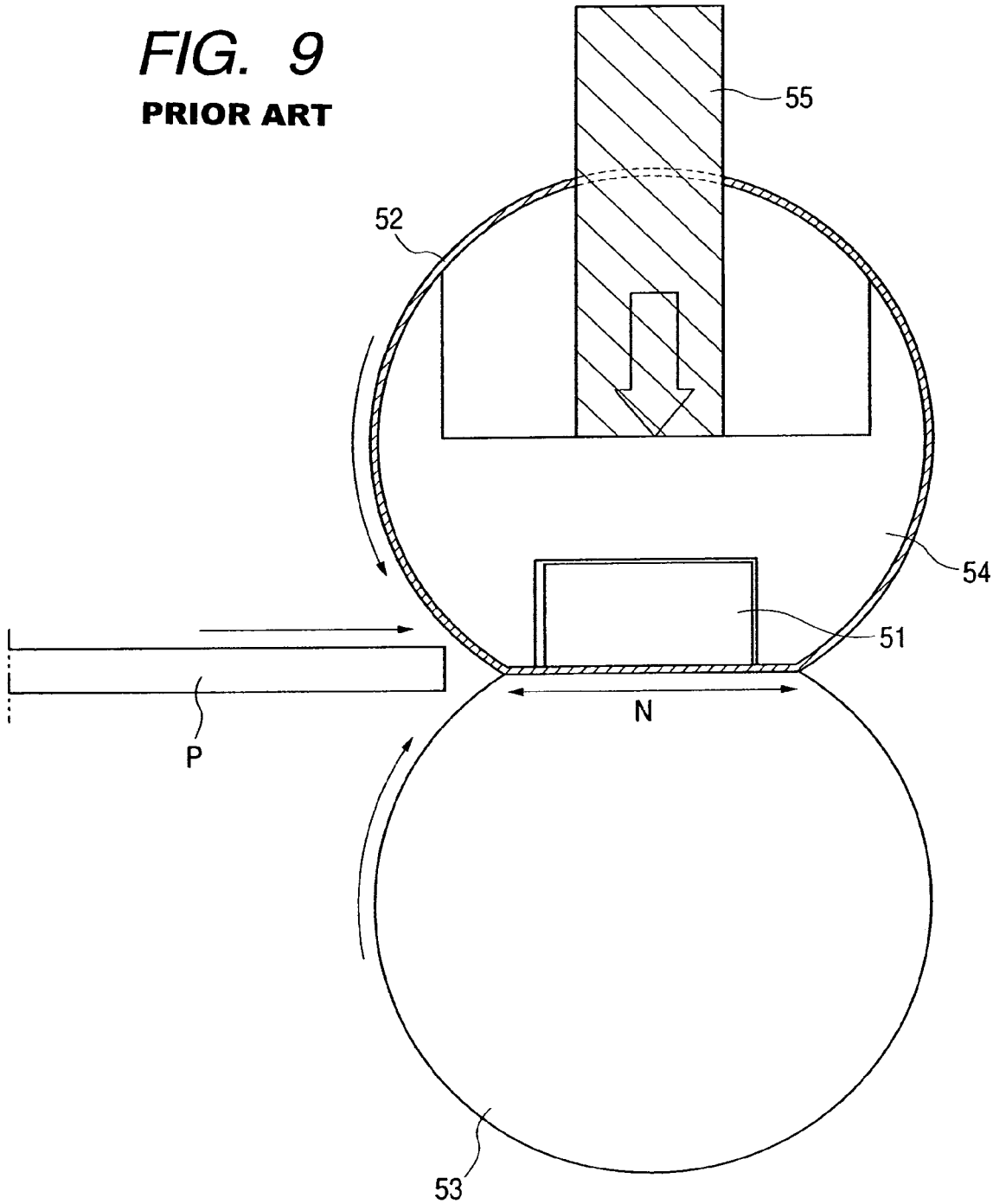
FIG. 9 PRIOR ART
FIG. 9 is a longitudinal cross-sectional view schematically showing the construction of a fixing apparatus according to conventional example 1.
Figure 10:
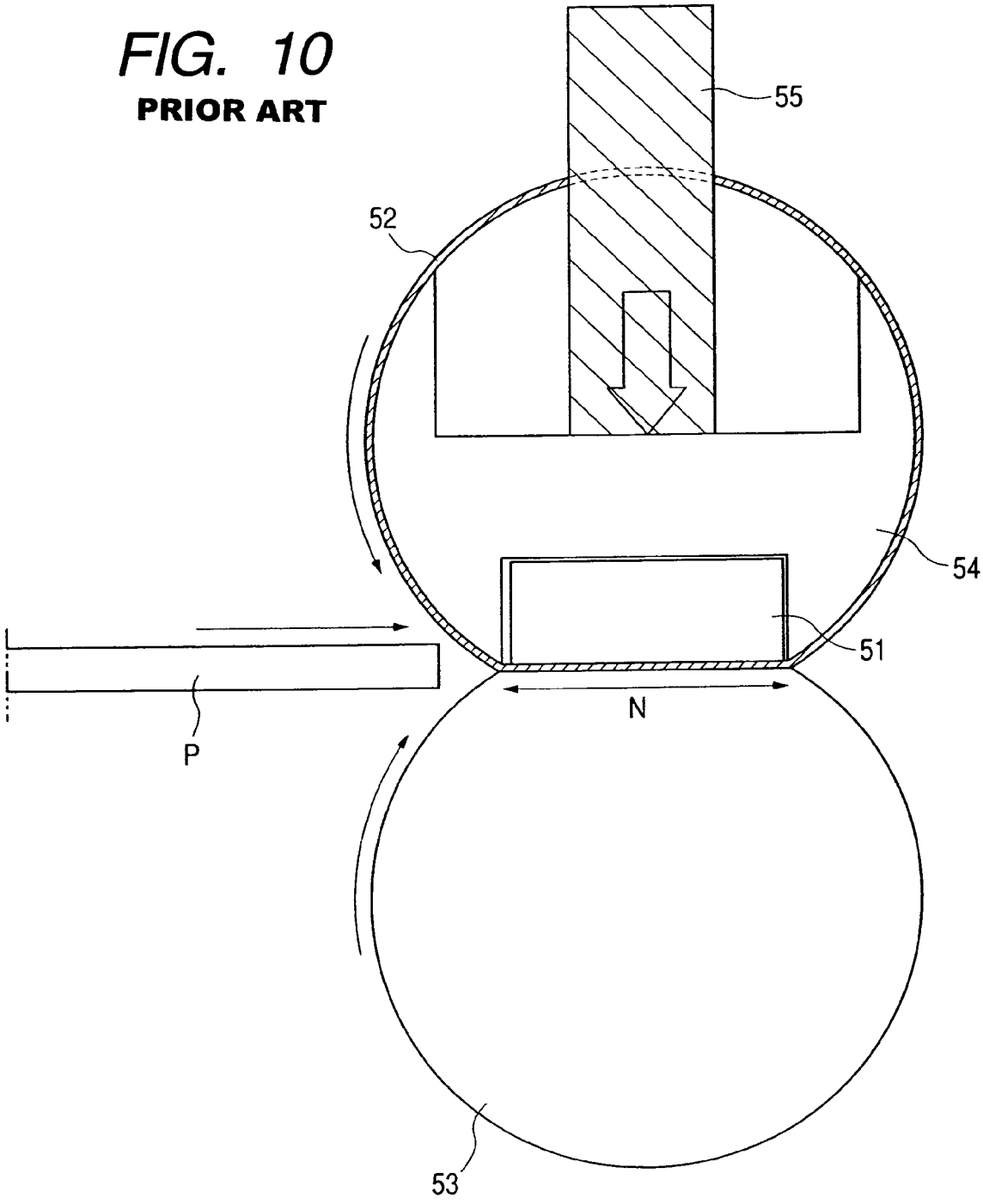
FIG. 10 PRIOR ART
FIG. 10 is a longitudinal cross-sectional view schematically showing the construction of a fixing apparatus according to conventional example 2.

Further, FIG. 8 shows the relation between the number of endurable sheets (the number of sheets corresponding to the cumulative operating time of the apparatus) and the hardness of the pressure roller, and the relation between the number of endurable sheets and the nip width, and the axis of abscissas thereof represents the number of endurable sheets, and the axis of ordinates represents the hardness (Asker-C total load 5.88 N) and the nip width (pressure force 150 N). It will be seen that for example, a pressure roller having initial hardness of 47° changes to hardness of 43° for 200,000 endurable sheets, and along therewith, the nip width changes from 7.2 mm to 7.7 mm, an increase of about 0.5 mm.

When design has heretofore been made such that nip width≦heater width at the initial stage of use of the apparatus, it has been necessary to design the heating member in advance so as to be large such that the nip width does not become greater than the heater width even if the nip width widens after endurance. In such construction, however, it is necessary to use a heater of a great width in advance, and the cost of the heater becomes high. On the other hand, when design has been made from the initial stage of use of the apparatus such that heater width≦nip width, it is necessary to suppress the change in the hardness of the pressure roller irrespective of the number of endurable sheets in order to make the pressure applied to the edge of the heater constant irrespective of the number of endurable sheets, and the yield of the roller has been bad.

In contrast, in the present embodiment, the protruding portion 32 of the heater holder protrudes more toward the pressure roller 26 side than the surface of contact of the heater 20 with the fixing film and the bottom surface of the groove portion 33 is more depressed than the surface of contact of the heater 20 with the fixing film and therefore, even if design is made in advance such that the relation that heater width≦nip width is provided, the pressure applied to the edge of the heater can be made small and driving torque can be suppressed. Also, even if the hardness of the pressure roller becomes lower and the nip width gradually becomes greater as the use of the apparatus progresses, an increase in driving torque is suppressed for the following reason.

Figure 4A:
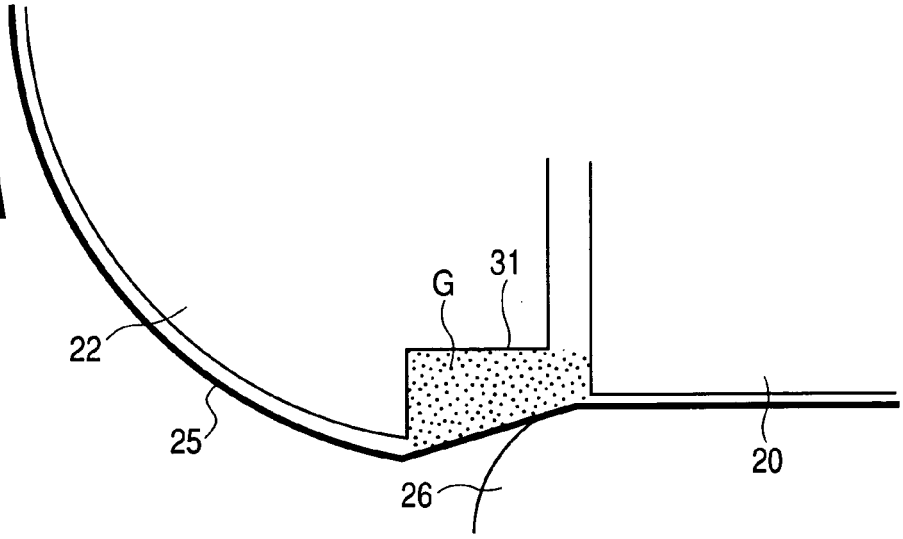
FIG. 4A shows the track of film by the endurance of the fixing apparatus according to the first embodiment in an initial state.
Figure 4B:
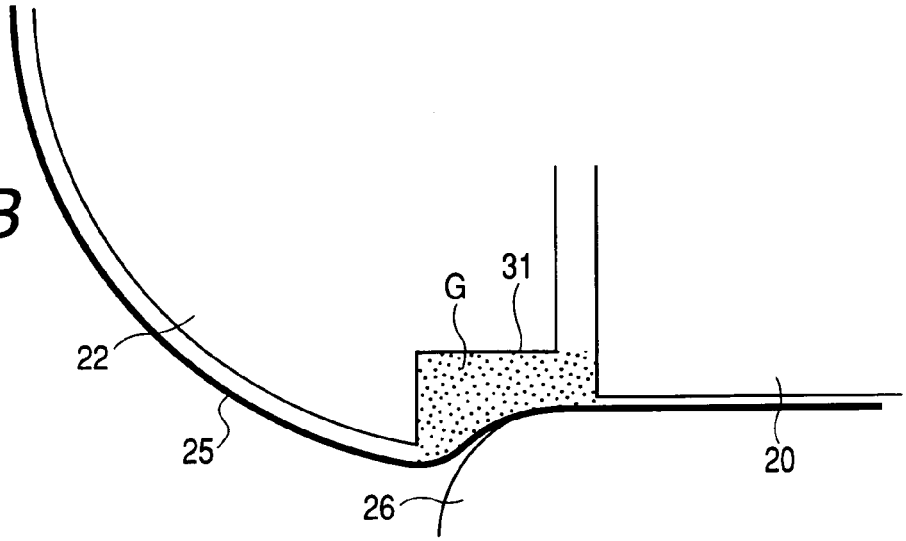
FIG. 4B shows the track of the film by the endurance of the fixing apparatus according to the first embodiment when 50,000 sheets have passed.
Figure 4C:
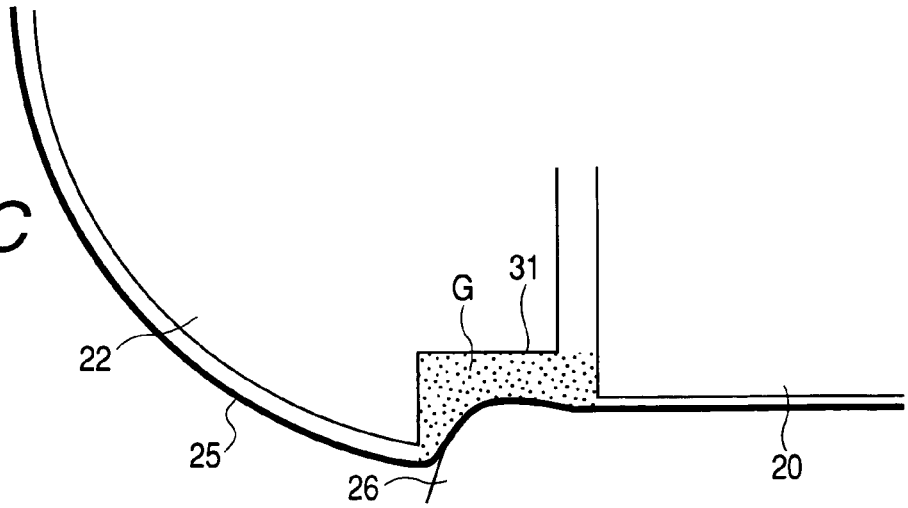
FIG. 4C shows the track of the film by the endurance of the fixing apparatus according to the first embodiment when 100,000 sheets have passed.

That is, in the present embodiment, the change in the hardness of the pressure roller is utilized to form the nip part N as shown in FIG. 2. That is, there is the relation that nip width≧heater width from the initial stage of use of the apparatus, and further by an increase in the number of endurable sheets, the track of the fixing film changes as shown in FIGS. 4A, 4B and 4C. FIG. 4A shows the track of the fixing film in an initial state, FIG. 4B shows the track of the fixing film when 50,000 sheets have passed, and FIG. 4C shows the track of the fixing film when 100,000 sheets have passed. As shown in FIGS. 4A, 4B and 4C, the amount of entry of the fixing film 25 into the groove portion (lubricant containing portion) 33 becomes greater with an increase in the nip width resulting from an increase in endurance. When 100,000 sheets have been printed as shown in FIG. 4C, the elasticity of the pressure roller is reduced as much as the fixing film passes a position more depressed than the surface of contact of the heater with the fixing film. In the present embodiment, however, the grease G as a lubricant is applied to the groove portion 33 and therefore, even if the amount of entry of the fixing film into the groove portion 33 increases, the contact between the back of the fixing film 25 and the grease G always occurs. Even in a state in which the elasticity of the pressure roller has been considerably reduced as after the printing of 100,000 sheets, sufficient grease is present in the groove portion. Also, even if the elasticity of the pressure roller is reduced, the fixing film escapes into the groove portion and therefore, the pressure applied to the surface of contact of the heater 20 with the fixing film is stable irrespective of the number of endurable sheets, and faulty fixing does not result. As described above, even if the amount of entry of the fixing film into the groove portion 33 increases, any increase in driving torque can be suppressed and faulty fixing can also be suppressed.

When the grease G is to be applied to the groove portion 33, the effect of the grease is greater if the grease is applied in a greater amount than the volume of the groove portion 33 and therefore, in the present embodiment, 170 mg of grease G is applied. In the present embodiment, HP300, G8005, G8010, G8020 or the like produced by Dow Corning Asia Ltd. is adopted as the grease G.

The grease G is always in contact with the back of the fixing film 25 even if endurance progresses, and the grease can be supplied to the heater portion (pressing portion) irrespective of the endurance state, and it never happens that the heat-resistant film strongly strikes against the edge of the heating member and therefore, good friction can be secured.

Figure 5:
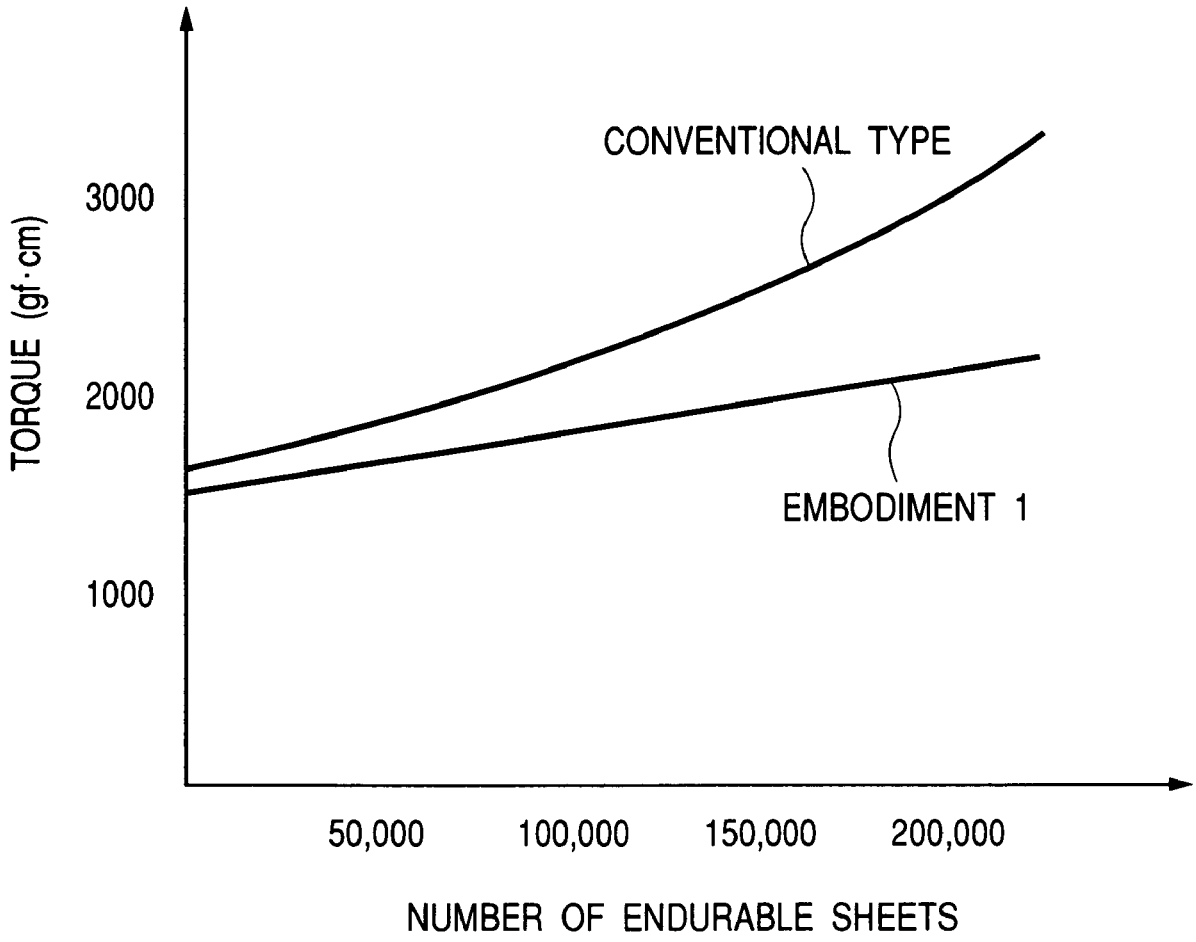
FIG. 5 shows changes in the torque of a conventional example and the fixing apparatus according to the first embodiment.

FIG. 5 shows changes in torque by endurance. Heretofore, the grease in the portion of contact (nip pressure portion) between the heating member and the heat-resistant film has become deteriorated and therefore, the torque has been suddenly increased. In the present embodiment, the grease is always supplied to the nip pressure portion and therefore, as shown in FIG. 5, there is little or no change in torque.

Thereby, the lubricant can be made to lubricate well and by the passing of paper, any increase in torque can be prevented, and the occurrence of the inconvenience that the fixing film does not rotate and the recording material cannot be transported becomes null.

That is, a lubricant supplying member is provided upstream of the nip of the fixing heater, and the fixing nip construction (heater width, pressure force and changes in the hardness of the pressure roller) is properly set, and by a change in endurance by the nip, a fresh lubricant can always be supplied and circulated to the fixing nip part till the end of the life, and the increase in torque and faulty images by the paper supply endurance can be prevented. It is possible to prevent the increase in the torque of the fixing unit caused by paper supply, and eliminate faulty images such as slip without making the apparatus bulky and higher in cost.

(Second Embodiment)

A second embodiment of the present invention will hereinafter be described with reference to FIGS. 6A and 6B, but portions in FIGS. 6A and 6B similar to those in FIGS. 2 and 3 need not be described.

In the image heating apparatus according to the first embodiment shown in FIGS. 2 and 3, the supplied amount of lubricant is gradually changed by endurance and therefore, the supply conforming to the paper supply situation, for example, the supplied amount of lubricant during continuous paper supply or small-size paper supply, has been somewhat unstable. In the present embodiment, a lubricant supplying member 31 discrete from the heater holder is provided as the bottom surface of the groove portion, and this lubricant supplying member 31 is formed of a material higher in coefficient of thermal expansion than the heater holder 22. Thus, the lubricant supplying member 31 is expanded by the heat of the heating member 20 during paper supply and therefore, stable supply becomes possible in conformity with the situation. The lubricant supplying member 31, however, if expanded, must be expanded to such a degree that it does not protrude from the heating member 20 toward the pressure roller 26 side.

Figure 6A:
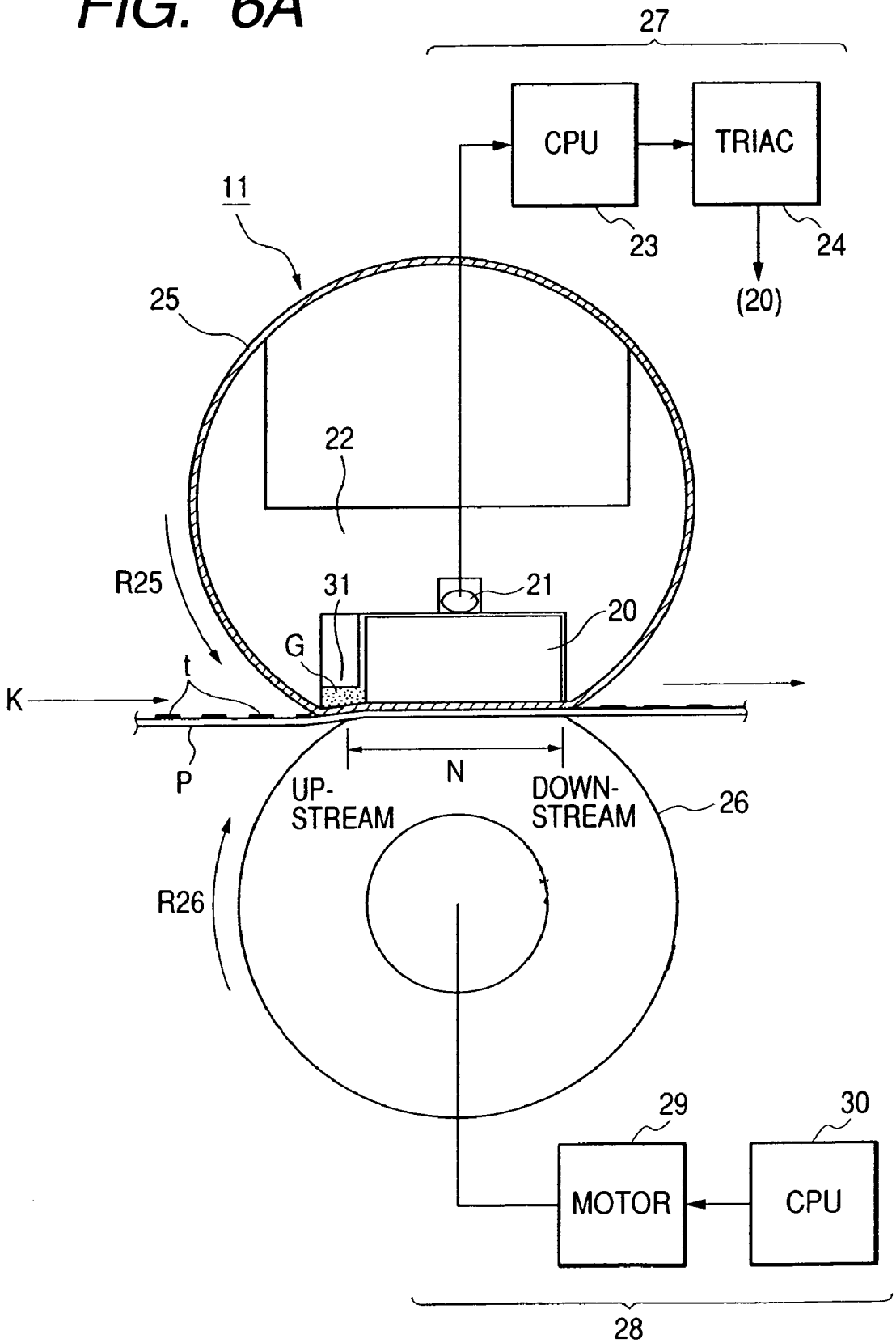
FIG. 6A is a transverse cross-sectional view schematically showing the construction of a fixing apparatus according to a second embodiment of the present invention.
Figure 6B:
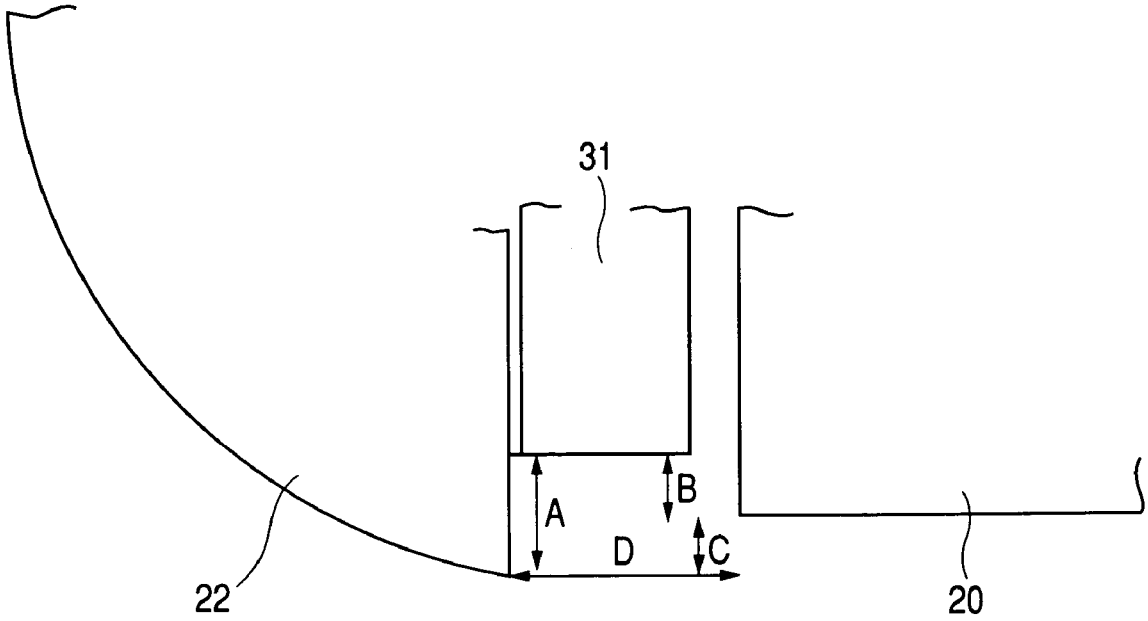
FIG. 6B is a detailed view showing the construction of the nip part of the fixing apparatus according to the second embodiment.

FIGS. 6A and 6B show the details of the nip part N in the image heating apparatus of the present invention, and the inner surface of the film in the nip upstream portion is provided with the lubricant supplying member 31 shown in FIGS. 6A and 6B besides the heater 20, and the lubricant supplying 31 is expanded in a hot state such as continuous paper supply and therefore, comes close to the heat-resistant film. At this time, the grease G held in the groove portion among the lubricant supplying member 31, the heater holder 22, the heater 20 and the fixing film 25 contacts with the back of the heat-resistant film 25 and is sequentially transported to the pressure portion. Further, during the cooling down such as the post-rotation after the fixing process has been finished, the lubricant supplying member 31 contracts and therefore, any excess grease adhering to the back of the film is again applied to the lubricant supplying member 31, and the lubricant supplying member can be prepared for the next starting. The grease can be thus circulated and therefore, good torque can be maintained irrespective of the paper supply situation.

Figure 7:
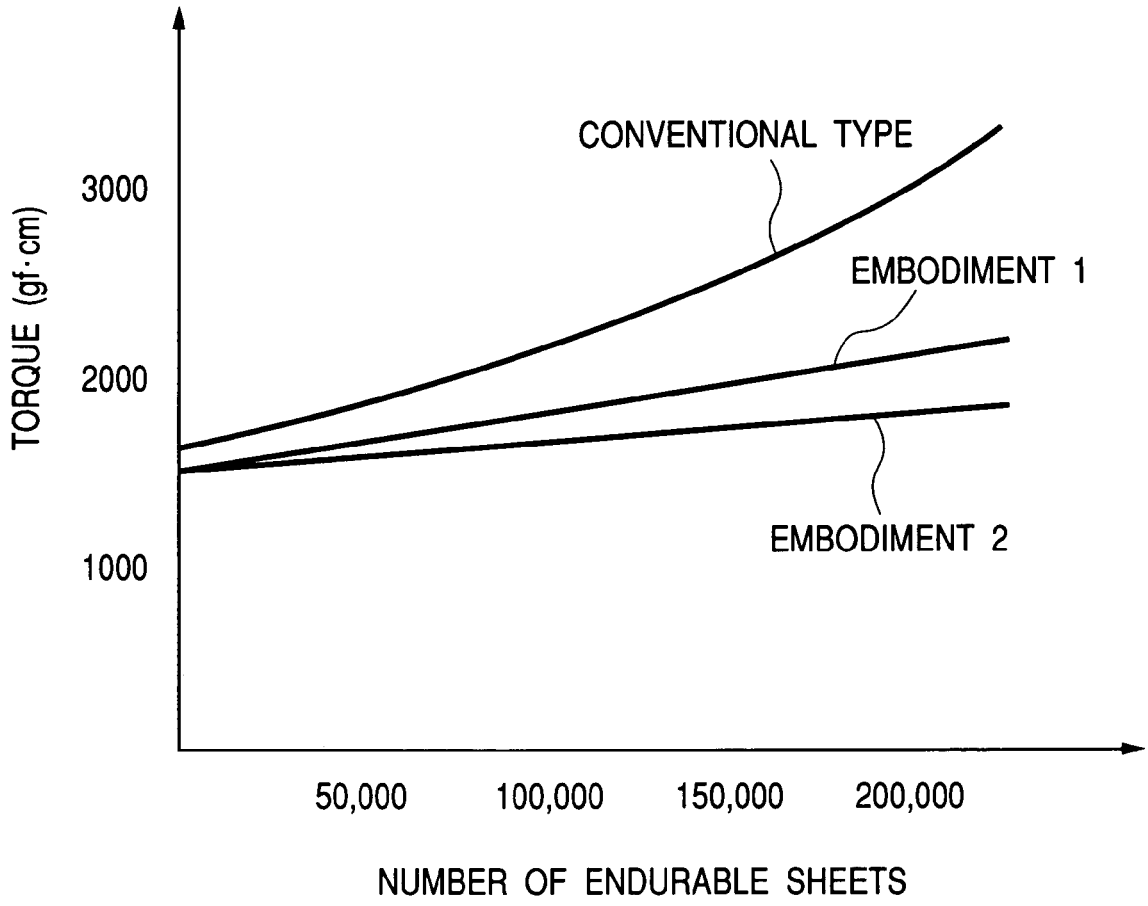
FIG. 7 shows changes in the torque of a conventional example and the fixing apparatuses according to the present invention by endurance.

FIG. 7 shows changes in torque by endurance. Heretofore, the grease in the portion of contact has become deteriorated and therefore the torque has suddenly increased. Further, depending on the paper supplying situation, the supplied amount of lubricant has been unstable, and depending on the way of use, the torque has sometimes risen. In the present embodiment (Embodiment 2), the grease is stably supplied in conformity with the paper supply situation and therefore, as shown in FIG. 7, there is little or no change in torque. Thus, it is of course possible to prevent a state in which the fixing film does not rotate and the recording material cannot be transported, and it is possible to use a motor smaller in driving torque as the driving motor of the image heating apparatus, and this also leads to a reduction in the cost of the motor.

(Others)

a) In the first embodiment and the second embodiment, the heating member 20 is not restricted to a ceramic heater, but use can be made, for example, of a positive temperature coefficient (PTC) heater, an electromagnetic induction heat generative member or the like.

b) The pressure rotatable member can be an endless belt member having an elastic member, instead of the roller member having an elastic member. Also, a pressure film unit comprising an endless belt and a pressure member disclosed, for example, in Japanese Patent Application Laid-Open No. 2001-228731 may be used to achieve a smaller heat capacity.

c) As one flexible rotatable member, the film can also assume a construction in which the film is passed over a drive roller and a tension roller and is driven (film driving type).

d) The image heating apparatus of the present invention is not restricted as the image fixing apparatus according to the embodiment, but can be widely used as means or an apparatus for heating a material to be heated, such as an image heating apparatus for heating a recording material bearing an image thereof to thereby improve a surface property such as gloss, an image heating apparatus for tentatively fixing an image, a heating and drying apparatus for a material to be heated or a heating laminate apparatus.

While various examples and embodiments of the present invention have been shown and described above, it will be understood by those skilled in the art that the gist and scope of the present invention are not restricted to the particular description herein and the drawings, but extend to the various modifications and changes all set forth in the appended claims.

What is claimed is:

1. An image heating apparatus for heating an image formed on a recording material, comprising:

a heater;

a supporting member for supporting said heater;

a flexible rotatable member rotating with contacting with said heater; and a backup member contacting said rotatable member;

wherein the recording material passes between said rotatable member and said backup member, and wherein upstream of said heater of said supporting member with respect to the direction of movement of the recording material, there are provided a protruding portion protruding more toward said backup member side than the surface of contact of said heater with said rotatable member, and a groove portion provided between said protruding portion and said heater and depressed more than the surface of contact of said heater with said rotatable member, and a lubricant is contained in said groove portion.

2. An image heating apparatus according to claim 1, wherein an area of contact between said rotatable member and said backup member in the direction of movement of the recording material is greater than the width of said heater.

3. An image heating apparatus according to claim 2, wherein in the direction of movement of the recording material, at least a portion of the groove portion is within the area of contact between said rotatable member and said backup member.

4. An image heating apparatus according to claim 1, wherein the depth of the groove portion is 0 mm or greater and 0.4 mm or less, and the width of the groove portion in the direction of movement of the recording material is five times as great as the depth of the groove portion or greater.

5. An image heating apparatus according to claim 1, wherein the bottom surface portion of the groove portion is formed of a material higher in coefficient of thermal expansion than said supporting member.

* * * * *

UNITED STATES PATENT AND TRADEMARK OFFICE

CERTIFICATE OF CORRECTION

PATENT NO. : 7,027,763 B2
APPLICATION NO. : 10/724634
DATED : April 11, 2006
INVENTOR(S) : Akira Kato et al.

It is certified that error appears in the above-identified patent and that said Letters Patent is hereby corrected as shown below:

COLUMN 6:
Line 8, "which" should read --(which--.

COLUMN 10:
Line 25, "all" should read --as--.
Line 33, "with" (1st occurrence) should read --while--.

Signed and Sealed this

Seventh Day of November, 2006

JON W. DUDAS
*Director of the United States Patent and Trademark Office*